US012650025B2

(12) United States Patent
Besnier

(10) Patent No.: US 12,650,025 B2
(45) Date of Patent: Jun. 9, 2026

(54) SWIMMING POOL CLEANER WITH MOTORIZED NOZZLE

(71) Applicant: ZODIAC POOL CARE EUROPE, Belberaud (FR)

(72) Inventor: Arnaud Besnier, Beaupuy (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 350 days.

(21) Appl. No.: 18/195,339

(22) Filed: May 9, 2023

(65) Prior Publication Data

US 2023/0366230 A1 Nov. 16, 2023

Related U.S. Application Data

(60) Provisional application No. 63/340,863, filed on May 11, 2022.

(51) Int. Cl.
*E04H 4/16* (2006.01)
*B63H 11/02* (2006.01)

(52) U.S. Cl.
CPC ..... *E04H 4/1654* (2013.01); *B63H 11/02* (2013.01)

(58) Field of Classification Search
CPC ..... E04H 4/1654; B63H 11/02
See application file for complete search history.

(56) References Cited

U.S. PATENT DOCUMENTS

2002/0129839 A1* 9/2002 Erlich ..... E04H 4/1663 134/22.18
2011/0203060 A1* 8/2011 Pichon ..... E04H 4/1654 15/1.7
2011/0258789 A1* 10/2011 Lavabre ..... E04H 4/1654 15/1.7
2016/0060887 A1* 3/2016 Tryber ..... E04H 4/1263 15/1.7
2019/0032356 A1* 1/2019 Witelson ..... E04H 4/1654
2023/0250664 A1* 8/2023 Tang ..... B62D 55/12
2024/0068257 A1* 2/2024 Besnier ..... E04H 4/1281

FOREIGN PATENT DOCUMENTS

EP 3023561 A1 5/2016
EP 3438380 A1 * 2/2019 ..... E04H 4/1654
WO 2019058286 A1 3/2019
WO 2020065589 A1 4/2020

OTHER PUBLICATIONS

International Application No. PCT/IB2023/054790, International Search Report and Written Opinion mailed on Jul. 27, 2023, 13 pages.
International Application No. PCT/IB2023/054790, International Preliminary Report on Patentability mailed on Nov. 21, 2024, 9 pages.

* cited by examiner

*Primary Examiner* — Brian Christopher Delrue
(74) *Attorney, Agent, or Firm* — Kilpatrick Townsend & Stockton LLP

(57) ABSTRACT

An automatic swimming pool cleaner (APC) includes a body having a fluid outlet and a nozzle assembly for controlling an orientation of fluid flow exiting the fluid outlet. The nozzle assembly includes a nozzle with a plurality of blades that are rotatable relative to the outlet. The nozzle assembly may also include an actuator and a transmitter for automatically rotating the blades and for automatically controlling the orientation of the fluid flow exiting the fluid outlet.

18 Claims, 4 Drawing Sheets

SWIMMING POOL CLEANER WITH MOTORIZED NOZZLE

REFERENCE TO RELATED APPLICATION

This application claims the benefit of U.S. Provisional Patent Application No. 63/340,863, filed on May 11, 2022, and entitled SWIMMING POOL CLEANER WITH MOTORIZED NOZZLE, the content of which is hereby incorporated by reference in its entirety.

FIELD OF THE INVENTION

This invention relates to concepts, systems, and apparatuses for cleaning water-containing vessels such as swimming pools and spas and more particularly, although not necessarily exclusively, to improvements to robotic automatic swimming pool cleaners (APCs).

BACKGROUND OF THE INVENTION

Numerous cleaning devices capable of autonomous movement within swimming pools and spas currently exist. The most common of these devices are APCs, which often are either hydraulic or robotic in type. Hydraulic cleaners vary water flow for movement, while robotic cleaners typically employ electric motors to cause motion. Hydraulic APCs, furthermore, subdivide into "pressure-side" and "suction-side" cleaners, with pressure-side cleaners being fluidly connected to outputs of pumps of pool water circulation systems and suction-side cleaners being fluidly connected to inputs of such pumps.

APCs may have features for controlling a flow fluid exiting a liquid outlet so that the fluid can flow in different directions, and the force crated by the flow may be used to move the APC. However, such features have typically extended substantially outwards from the APC, have limited control of the orientation (e.g., often to a predefined opening), and/or require a user to manually change the orientation.

SUMMARY

Embodiments covered by this patent are defined by the claims below, not this summary. This summary is a high-level overview of various embodiments and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

Various implementations described herein can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

DETAILED DESCRIPTION

Figure 1:
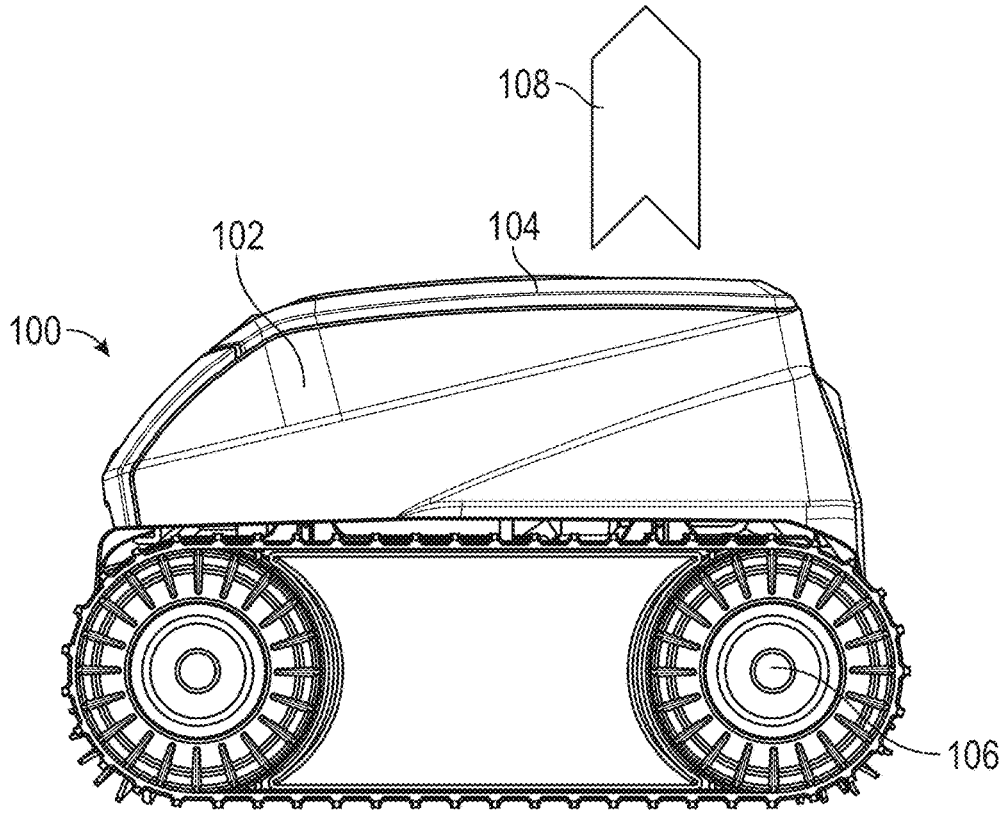
FIG. 1 illustrates an APC with fluid flow exiting the APC in a first orientation according to embodiments.

Described herein are nozzle systems and methods for APCs that may be used to control an orientation of a flow of fluid exiting a liquid outlet of the APC. In various embodiments, the nozzle systems described herein include a plurality of blades that are rotatable relative to an axis of the liquid outlet (e.g., a vertical axis of the APC) for controlling an angle of fluid flow relative to the axis. In certain embodiments, the blades may be adjustable such that the fluid flow may be substantially parallel to the axis and/or at one or more oblique angles relative to the axis. In one non-limiting example, the blades may be adjustable between an angle of 0°-70°, inclusive. The blades may be linked such that the blades rotate together. In certain embodiments, the nozzle systems described herein may be motorized or automatically actuated, which may allow for fast and precise positioning of the blades and thereby the orientation of fluid flow. The nozzle systems described herein may provide various benefits and advantages to an APC. Various other benefits and advantages may be realized with the systems and methods provided herein, and the aforementioned advantages should not be considered limiting.

FIGS. 1-4B illustrate an example of an APC 100 according to embodiments. The APC 100 may be various types of APCs as desired, including robotic and hydraulic APCs, which may be suitable for use with a pool. The APC 100 generally includes a body 102 and motive elements 106. The motive elements 106 may be various suitable devices or structures suitable for enabling movement of the APC 100 along a surface, including but not limited to wheels, rollers, feet, tracks, combinations thereof, and/or other suitable motive elements 106 as desired. The APC 100 optionally includes a cover 104 that may be rotatable or pivotable relative to the body 102 between a closed position (see, e.g., FIGS. 1 and 4A) and an open position (see, e.g., FIG. 4B) such that contents of the APC 100 within the body (e.g., motor block, filter, pump, controller, etc.) may be selectively accessed. The APC 100 optionally may include one or more cleaning elements suitable for cleaning a surface and/or directing debris into the APC 100 and/or towards a filter of the APC 100. As a non-limiting example, the APC 100 may include a brush assembly with one or more brushes.

In certain embodiments, the APC 100 may include at least one inlet for debris-laden water of the pool and at least one outlet 110 (see FIGS. 3A-B) for filtered water to be exhausted back into the pool. In the embodiment illustrated in FIG. 3, the outlet 110 is defined in the cover 104; however, in other embodiments, the outlet 110 may be provided at other locations as desired, including various locations on the body 102. The outlet 110 defines an outlet axis 111. In certain embodiments, the axis 111 may be substantially vertical, although it need not be in other embodiments.

Figure 2:
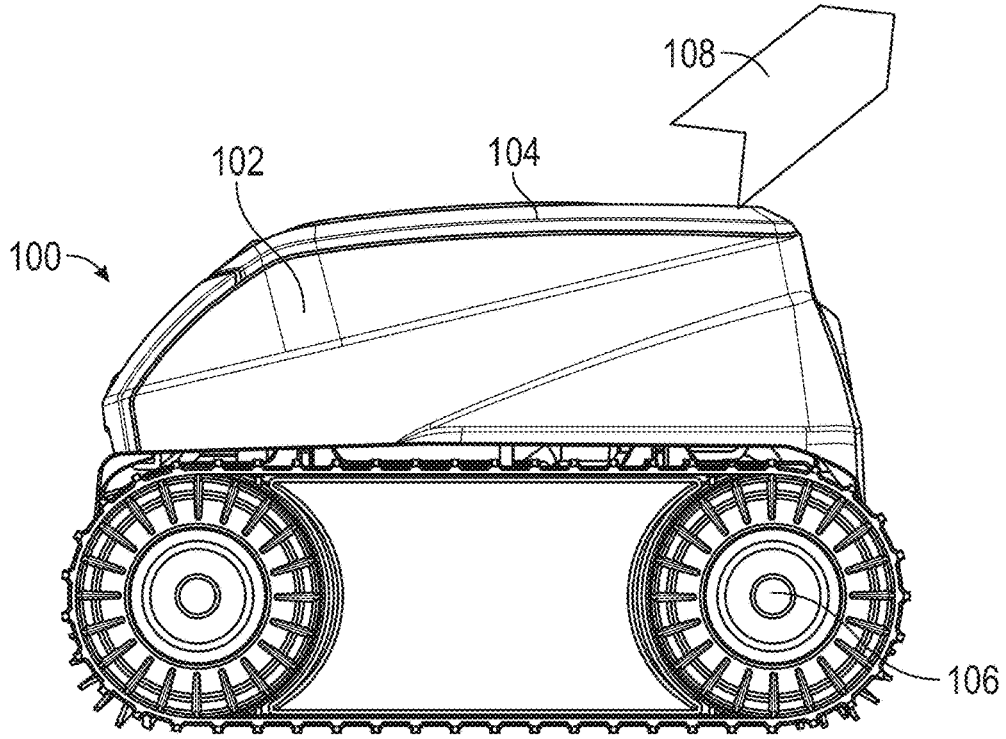
FIG. 2 illustrates the APC of FIG. 1 with fluid flow exiting the APC in a second orientation according to embodiments.
Figure 3A:
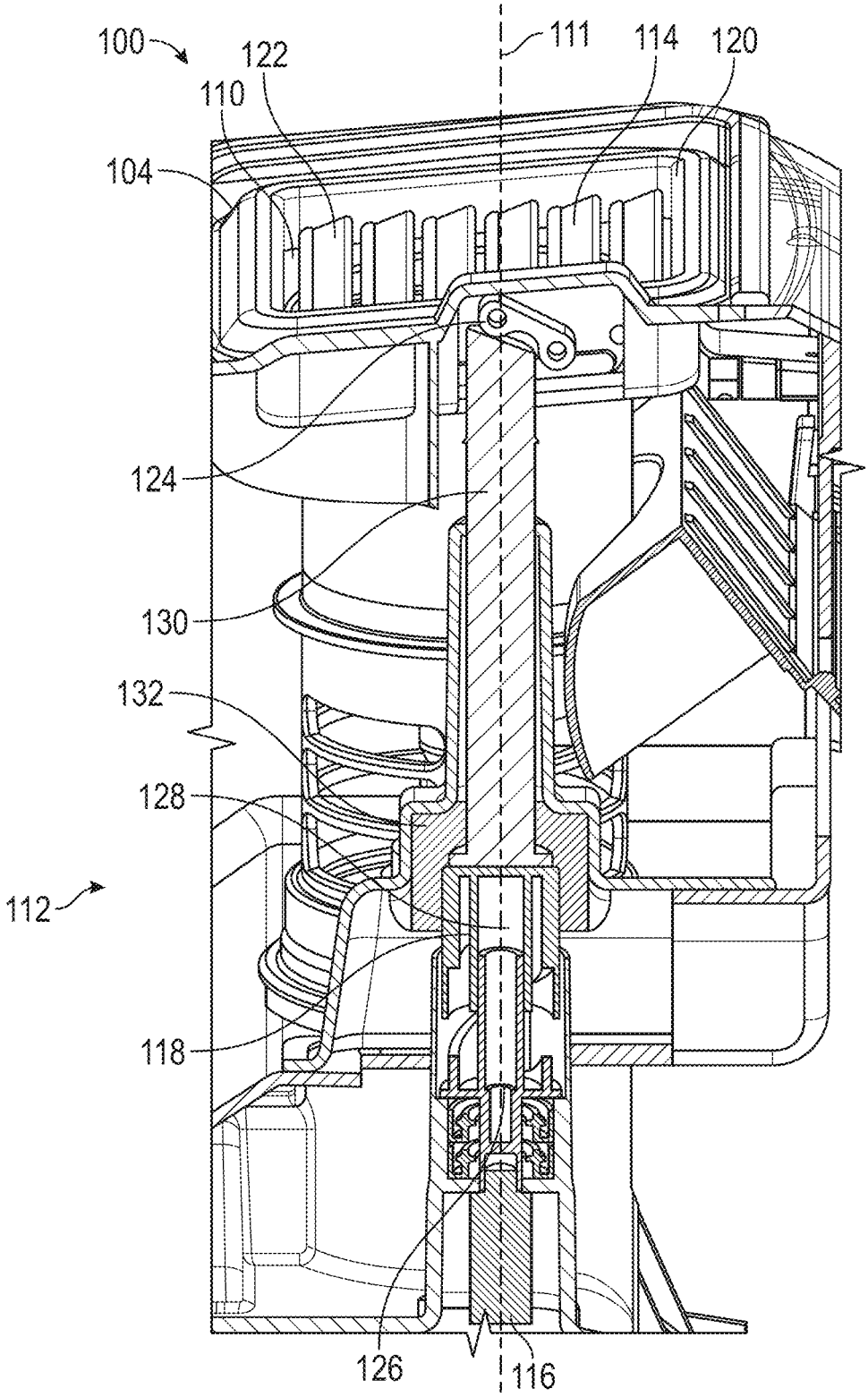
FIG. 3A illustrates a nozzle assembly of the APC of FIG. 1 with blades having an orientation according to embodiments.
Figure 3B:
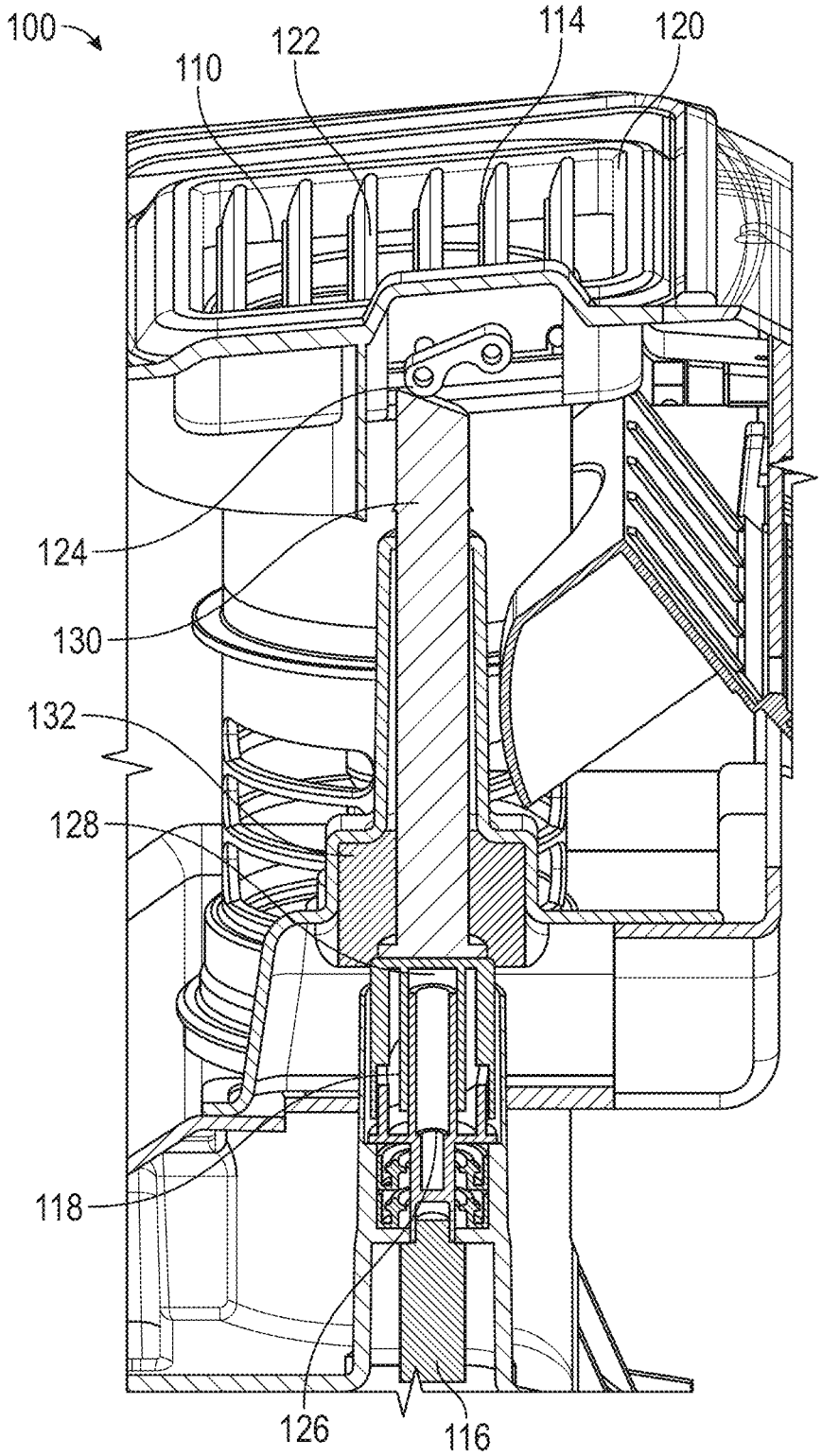
FIG. 3B illustrates the nozzle assembly of FIG. 3A with the blades having another orientation according to embodiments.
Figure 4A:
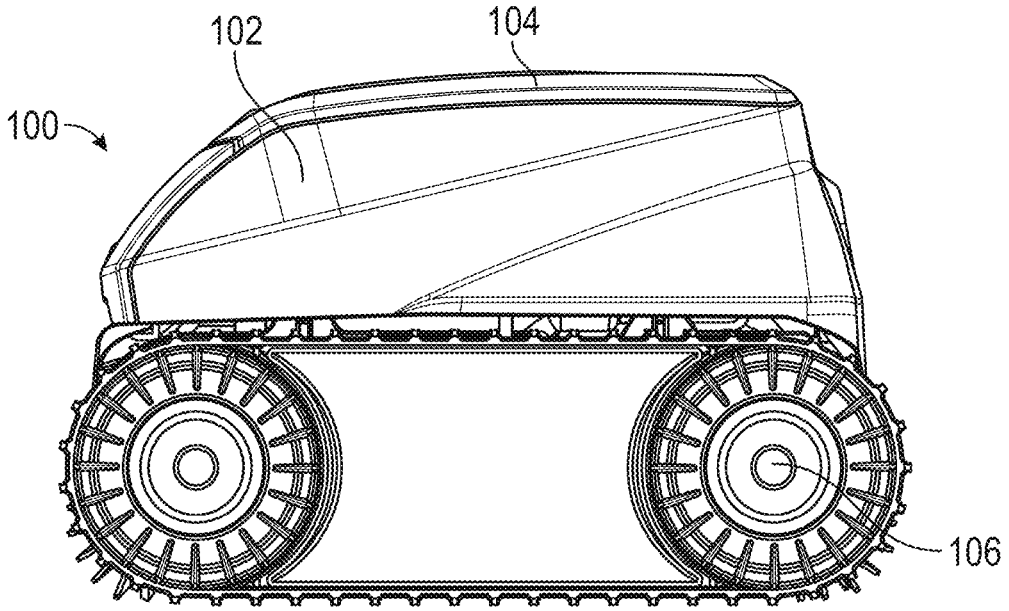
FIG. 4A illustrates the APC of FIG. 1 with the cover in a closed position.
Figure 4B:
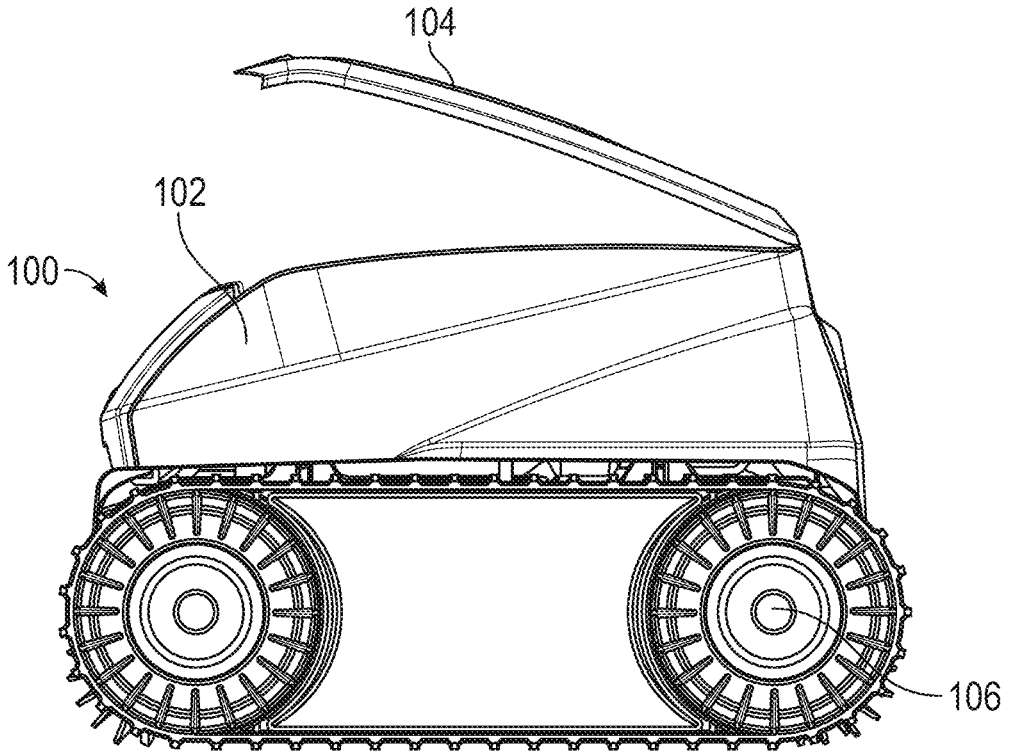
FIG. 4B illustrates the APC of FIG. 1 with the cover in an open position.

Referring to FIGS. 3A-B, the APC 100 includes a nozzle assembly 112 such that an orientation of fluid flow exiting the outlet is adjustable between a plurality of orientations. In certain embodiments, the nozzle assembly 112 may control the orientation of fluid flow 108 such that the fluid flow 108 is adjustable to a vertical (or first) orientation (see, e.g., FIGS. 1 and 3B) and one or more oriented or angled (or second) orientations (see, e.g., FIGS. 2 and 3A) relative to the axis 111. While two orientations are illustrated, the nozzle assembly 112 may control the orientation to be at other orientations between the first orientation and the second orientation, and/or any other orientations as desired, such as but not limited to other angled orientations that may be closer to a horizontal orientation.

The nozzle assembly 112 generally includes a nozzle 114, an actuator 116, and a transmitter 118.

The nozzle 114 may be provided within the outlet 110 and/or downstream from the outlet 110 for controlling the orientation of the fluid flow exiting the outlet 110. As illustrated in FIGS. 3A-B, the nozzle 114 may have minimized profile relative to the body 102 and/or cover 104 of the APC 100, meaning that the extent that the nozzle 114 projects outwards from the APC 100 is minimized or reduced.

The nozzle 114 includes a frame 120 and a plurality of blades 122 that are supported by the frame 120 and rotatable relative to the outlet 110. The frame 120 may define a closed perimeter having a receiving area, and the frame 120 may be positionable within and/or downstream from the outlet 110. In the embodiment illustrated, the frame 120 is positioned within the outlet 110.

The blades 122 may be rotatably supported on the frame 120 using various devices or mechanisms as desired, such as pins, rods, etc. In various embodiments, an axis of rotation of each blade 122 may be substantially perpendicular to the axis 111. In certain embodiments, one or more blades 122 are linked together via a connector or other suitable mechanisms or devices such that the one or more blades 122 rotate together. The blades 122 may be rotatable to be at various angles relative to the axis 111 of the outlet 110, thereby causing the fluid flow exiting the outlet 110 to be at various angles relative to the axis 111 of the outlet 110. As mentioned, FIGS. 3A-B illustrate non-limiting examples of orientations of the blades 122. In certain embodiments, the blades 122 are rotatable to be at various angles relative to the axis 111, such as from an angle of about 0° to about 70°, inclusive, relative to the axis 111, such as from about 0° to about 60°. In other embodiments, the blades may be at other angles as desired, including greater than about 70° and/or less than about 0°.

Optionally, the nozzle 114 includes an engagement feature 124 such as a lever that is operably coupled to the blades 122 such that movement of the engagement feature 124 causes rotation of the blades 122. In various embodiments, and as illustrated in FIGS. 3A-B, the engagement feature 124 may be provided on the frame 120 outside of the receiving area housing the blades 122. However, in other embodiments, the engagement feature 124 may be provided at various locations as desired.

The actuator 116 may be various suitable devices or mechanisms for causing automatic rotation of the blades 122 of the nozzle 114 and thereby automatic changing of the orientation of the fluid flow exiting the outlet 110. In the embodiment illustrated, the actuator 116 is a servo motor within a motor block of the APC 100 and that is configured to cause rotation of a positioning component 126. The actuator 116 may be controlled (e.g., activated or deactivated) via various devices or techniques as desired. As non-limiting examples, the actuator 116 may be controlled via a controller of the APC 100, buttons, switches, a user interface, a remote device (e.g., a user device in communication with the APC 100), couplings with other components of the APC 100, combinations thereof, and/or other devices or mechanisms as desired.

The transmitter 118 may be various suitable devices or mechanisms for causing rotation of the blades 122 (e.g., via the engagement feature 124) based on rotation or movement of the actuator 116—see, e.g., relative linear movement or translation of the transmitter 118 by comparing FIG. 3A with FIG. 3B. In the embodiment illustrated, the transmitter 118 includes a first component 128 that engages the positioning component 126 and a second component 130 that engages the engagement feature 124. The first component 128 is configured to engage the positioning component 126 such that rotation of the positioning component 126 (via the actuator 116) causes translation of the transmitter 118. As a non-limiting example, a 180° rotation of the positioning component 126 may cause a translation of about 15 mm; however, in other embodiments, rotation of the positioning component 126 may cause other translation as desired.

Optionally, at least a portion of the transmitter 118 (e.g., the first component 128 engaged with the actuator 116) may include a sealing member 132. The sealing member 132 may seal the actuator 116 while also allowing for translation of the transmitter 118.

In embodiments where the nozzle 114 is provided on the cover 104, the nozzle 114 may be movable with the cover 104 as the cover 104 is opened or moved relative to the body 102. In such embodiments, the nozzle 114 may become disengaged from the transmitter 118. Optionally, the second component 130 of the transmitter 118 may serve as a positioning feature for repositioning of the cover 104 relative to the body 102 and/or for guiding the nozzle 114 back into engagement with the transmitter 118.

In use, the APC 100 with the nozzle assembly 112 may allow for orientation of the fluid flow 108 at a plurality of angles relative to the axis 111. In particular, the actuator 116 may cause various degrees of rotation of the positioning component 126, which in turn causes various amounts of translation of the transmitter 118, which in turn causes various degrees of rotation of the blades 122. The fast and precise control of the actuator 116 may allow for the blades 122 to be at any number of positions relative to the axis 111, and the nozzle assembly 112 is not limited to having predefined outlet directions, thereby providing improve control of the fluid flow.

Exemplary concepts or combinations of features of the invention may include:

A. An APC comprising a fluid outlet and a nozzle comprising a plurality of rotatable blades for controlling an orientation of a flow of fluid exiting the fluid outlet between a plurality of directions.

B. The APC according to any preceding or subsequent statement or combination of statements, wherein the fluid outlet is on a body of the APC or a cover of the APC.

C. The APC according to any preceding or subsequent statement or combination of statements, wherein the plurality of blades are coupled such that the plurality of blades rotate together.

D. The APC according to any preceding or subsequent statement or combination of statements, wherein the nozzle is within or downstream from the fluid outlet.

E. The APC according to any preceding or subsequent statement or combination of statements, wherein each blade of the plurality of rotatable blades is rotatable about an axis substantially perpendicular to an axis of the fluid outlet.

F. The APC according to any preceding or subsequent statement or combination of statements, wherein the nozzle further comprises a frame defining a receiving area, wherein the plurality of blades are rotatably supported on the frame and within the receiving area.

G. The APC according to any preceding or subsequent statement or combination of statements, wherein the nozzle is motorized.

H. The APC according to any preceding or subsequent statement or combination of statements, wherein the nozzle comprises a servo-motor.

I. The APC according to any preceding or subsequent statement or combination of statements, wherein the nozzle comprises a motor and a transmitter, wherein the motor is rotatable, wherein the transmitter is linearly movable based on rotation of the motor, and wherein movement of the transmitter positions the plurality of blades.

J. An APC comprising a body, a cover pivotably connected to the body, a fluid outlet on the cover, and a nozzle for controlling an orientation of a flow of fluid exiting the fluid outlet between a plurality of directions.

K. The APC according to any preceding or subsequent statement or combination of statements, further comprising an actuator and a transmitter, the transmitter comprising a first component rotatable by the actuator and a second component movable along an axis based on rotation of the first component, the second component configured to engage the nozzle.

L. The APC according to any preceding or subsequent statement or combination of statements, wherein the nozzle comprises a plurality of rotatable blades, wherein the second component is configured to engage the nozzle to rotate the plurality of rotatable blades.

M. The APC according to any preceding or subsequent statement or combination of statements, wherein the actuator is within a motor block of the body of the APC.

N. An APC comprising a fluid outlet and a nozzle assembly, the nozzle assembly comprising an actuator, a transmitter, and a nozzle comprising a plurality of blades, wherein the transmitter couples the actuator with the nozzle such that rotation of the actuator causes rotation of the plurality of blades for controlling an orientation of fluid flow exiting the fluid outlet between a plurality of directions.

O. The APC according to any preceding or subsequent statement or combination of statements, wherein the nozzle comprises a lever coupled to the plurality of blades, and wherein the transmitter is configured to engage the lever of the nozzle.

P. An APC comprising a fluid outlet and a nozzle comprising a frame defining a receiving area and at least one blade on the frame within the receiving area, the at least one blade rotatable for controlling an orientation of fluid flow exiting the fluid outlet between a plurality of directions.

Q. An APC comprising a fluid outlet comprising an outlet axis and a nozzle comprising a plurality of rotatable blades, the plurality of blades rotatable such that each blade is adjustable to extend at an angle relative to the outlet axis from 0° to 70° relative to the outlet axis.

R. The APC according to any preceding or subsequent statement or combination of statements, wherein the nozzle further comprises a lever for controlling an angle of the plurality of rotatable blades.

S. The APC according to any preceding or subsequent statement or combination of statements, wherein the nozzle further comprises a frame defining a receiving area, wherein the plurality of blades are within the receiving area, and wherein the lever is outside of the receiving area.

T. A method of controlling an orientation of fluid flow exiting a fluid outlet of an APC, the method comprising causing rotation of a plurality of blades of a nozzle using an actuator.

U. A nozzle assembly for an automatic swimming pool cleaner as shown in FIGS. 1-3.

U.S. application Ser. No. 17/267,012 to Durin et al. ("Durin application") illustrates another example of an APC with a nozzle assembly according to embodiments. The Durin application is incorporated herein by reference in its entirety.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention. Further, although applicant has described devices and techniques for use principally with APCs, persons skilled in the relevant field will recognize that the present invention conceivably could be employed in connection with other objects and in other manners.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g., 1 to 6.1, and ending with a maximum value of 10 or less, e.g., 5.5 to 10. The term "about" includes the exact value.

As used herein, the meaning of "a," "an," and "the" includes singular and plural references unless the context clearly dictates otherwise.

The subject matter of embodiments is described herein with specificity to meet statutory requirements, but this description is not necessarily intended to limit the scope of the claims. The claimed subject matter may be embodied in other ways, may include different elements or steps, and may be used in conjunction with other exiting or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing; however, such direction references or identifies should not be considered limiting. References to "pools" and "swimming pools" herein may also refer to spas or other water containing vessels used for recreation or therapy and for which cleaning of debris is needed or desired.

That which is claimed:

1. An automatic swimming pool cleaner (APC) comprising:

a body;

a cover pivotably connected to the body and movable relative to the body between open and closed positions;

a fluid outlet; and a nozzle comprising a plurality of rotatable blades for controlling a flow of fluid exiting the fluid outlet such that an orientation of the flow of fluid is adjustable, wherein the rotatable blades are attached to the cover of the APC.

2. The APC according claim 1, wherein the plurality of blades are coupled such that the plurality of blades rotate together.

3. The APC according to claim 1, wherein the nozzle is within the fluid outlet.

4. The APC according to claim 1, wherein the nozzle is downstream from the fluid outlet.

5. The APC according to claim 1, wherein each blade of the plurality of rotatable blades is rotatable about an axis perpendicular to an axis of the fluid outlet.

6. The APC according to claim 1, wherein the nozzle further comprises a frame defining a receiving area, wherein the plurality of blades are rotatably supported on the frame and within the receiving area.

7. The APC according to claim 1, wherein the nozzle is motorized.

8. The APC according to claim 1, wherein the fluid outlet comprises an outlet axis and the plurality of blades are rotatable such that each blade is adjustable to extend at an angle relative to the outlet axis from 0° to 70° relative to the outlet axis.

9. The APC according to claim 1, wherein the nozzle comprises a motor and a transmitter, wherein the motor is rotatable, wherein the transmitter is linearly movable based on rotation of the motor, and wherein movement of the transmitter positions the plurality of blades.

10. An automatic swimming pool cleaner (APC) comprising:

a body;

a cover pivotably connected to the body and movable relative to the body between open and closed positions;

a fluid outlet on the cover; and a nozzle for controlling a flow of fluid exiting the fluid outlet such that an orientation of the flow of fluid is adjustable, wherein the nozzle is on the cover.

11. The APC according to claim 10, further comprising:

an actuator; and a transmitter comprising a first component rotatable by the actuator and a second component movable along an axis based on rotation of the first component, wherein the second component configured to engage the nozzle.

12. The APC according to claim 11, wherein the nozzle comprises a plurality of rotatable blades, wherein the second component is configured to engage the nozzle to rotate the plurality of rotatable blades.

13. The APC according to claim 11, wherein the actuator is within a motor block of the body of the APC.

14. An automatic swimming pool cleaner (APC) comprising:

a body;

a cover pivotably connected to the body and movable relative to the body between open and closed positions;

a fluid outlet; and a nozzle assembly comprising an actuator, a transmitter, and a nozzle comprising a plurality of blades, wherein the transmitter couples the actuator with the nozzle such that rotation of the actuator causes rotation of the plurality of blades for controlling an orientation of fluid flow exiting the fluid outlet between a plurality of directions, and wherein the nozzle is configured to disengage the transmitter based on movement of the cover from the closed position.

15. The APC according to claim 14, wherein the nozzle comprises a lever coupled to the plurality of blades, and wherein the transmitter is configured to engage the lever of the nozzle.

16. The APC according to claim 14, wherein the nozzle comprises a frame defining a receiving area, and wherein at least one blade of the plurality of blades is on the frame within the receiving area.

17. The APC according to claim 14, wherein the fluid outlet comprises an outlet axis and the plurality of blades are rotatable such that each blade is adjustable to extend at an angle relative to the outlet axis from 0° to 70° relative to the outlet axis.

18. The APC according to claim 17, wherein the nozzle further comprises a lever for controlling an angle of the plurality of rotatable blades.

* * * * *